US009266586B2

(12) United States Patent
Roodenburg et al.

(10) Patent No.: US 9,266,586 B2
(45) Date of Patent: Feb. 23, 2016

(54) OFFSHORE VESSEL AND METHOD OF OPERATION OF SUCH AN OFFSHORE VESSEL

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/400,176

(22) PCT Filed: May 6, 2013

(86) PCT No.: PCT/NL2013/000025

§ 371 (c)(1),
(2) Date: Nov. 10, 2014

(87) PCT Pub. No.: WO2013/169099

PCT Pub. Date: Nov. 14, 2013

(65) Prior Publication Data

US 2015/0096761 A1 Apr. 9, 2015

Related U.S. Application Data

(60) Provisional application No. 61/645,910, filed on May 11, 2012.

(51) Int. Cl.
*E21B 19/09* (2006.01)
*B63B 39/00* (2006.01)
(Continued)

(52) U.S. Cl.
CPC ..... *B63B 35/4413* (2013.01); *B63B 15/00* (2013.01); *B63B 17/00* (2013.01);
(Continued)

(58) Field of Classification Search
CPC ... E21B 19/002; E21B 19/004; E21B 19/006; E21B 19/09; E21B 19/22; E21B 33/035; B63B 35/4413; B63B 39/00; B63B 15/00; B63B 17/00
USPC ..... 175/7; 114/268, 269, 201 R, 202; 166/352, 355, 367
See application file for complete search history.

(56) References Cited

U.S. PATENT DOCUMENTS 3,421,581 A * 1/1969 Geijn ..... 166/355
3,681,928 A * 8/1972 Vincken et al. ..... 405/196
(Continued)

FOREIGN PATENT DOCUMENTS

EP 1103459 A1 5/2001
EP 2186993 A1 5/2010
(Continued)

*Primary Examiner* — James G Sayre
(74) *Attorney, Agent, or Firm* — Birch, Stewart, Kolasch & Birch, LLP

(57) ABSTRACT

An offshore vessel capable of installing and removing a subsea well control device and a riser string includes a hoisting device having a travelling block for connecting a load. The travelling block is displaceable along a firing line which extends through a moonpool and a heave compensation system. The vessel further includes a working deck supported by the hull of the vessel which covers at least a portion of the moonpool to allow the assembly of a riser string. The working deck is provided with a riser string suspension device that allows to suspend a top end of a string of risers. A heave compensation connection system is adapted to connect the working deck to the travelling block, such that the hoisting device can move the working deck when the working deck is connected to the travelling block between a lowered riser assembly position and a raised heave compensated position.

20 Claims, 15 Drawing Sheets

(51) Int. Cl.

| | |
|---|---|
| ***B63B 17/00*** | (2006.01) |
| ***B63B 35/44*** | (2006.01) |
| ***E21B 19/22*** | (2006.01) |
| ***E21B 19/00*** | (2006.01) |
| ***B63B 15/00*** | (2006.01) |
| ***E21B 33/035*** | (2006.01) |

(52) U.S. Cl.
CPC ..... *B63B 39/00* (2013.01); *E21B 19/006* (2013.01); *E21B 19/09* (2013.01); *E21B 19/22* (2013.01); *E21B 33/035* (2013.01)

(56) References Cited

U.S. PATENT DOCUMENTS

| | | | | |
|---|---|---|---|---|
| 4,121,806 | A * | 10/1978 | Iato et al. | 166/355 |
| 2004/0134666 | A1 * | 7/2004 | Orr et al. | 166/379 |
| 2012/0132435 | A1 * | 5/2012 | Yemington | 166/355 |

FOREIGN PATENT DOCUMENTS

| | | | |
|---|---|---|---|
| WO | WO 2010/071444 | A1 | 6/2010 |
| WO | WO 2011/034422 | A2 | 3/2011 |

* cited by examiner

OFFSHORE VESSEL AND METHOD OF OPERATION OF SUCH AN OFFSHORE VESSEL

CROSS REFERENCE TO RELATED APPLICATIONS

This application is the National Phase of PCT/NL2013/000025 filed on May 6, 2013, which claims priority under 35 U.S.C. 119(e) to U.S. Provisional Application No. 61/645,910 filed on May 11, 2012, all of which are hereby expressly incorporated by reference into the present application.

BACKGROUND OF THE INVENTION

1. Field of the Invention

The present invention relates to an offshore vessel capable of installing and removing a subsea well control device and a riser string, the vessel comprising a hull having a moonpool;

a mast having a top side and a base connected to the hull of the vessel, which mast is provided above or adjacent the moonpool;

a hoisting device supported by the mast for raising and lowering a load, such as a riser string, comprising a travelling block for connecting the load to the hoisting device, which travelling block is displaceable along a firing line which extends through the moonpool;

a heave compensation system associated with the hoisting device, for damping the effect of the movement of the vessel as a result of sea-state induced vessel motion on the load attached to the travelling block;

a working deck supported by the hull of the vessel which covers at least a portion of the moonpool to allow the assembly of a riser string, and wherein the firing line extends through an opening in said working deck, such that the hoisting device can raise and lower a load, such as the riser string, through the opening in the working deck, wherein said working deck is provided with a riser string suspension device that allows to suspend a top end of a string of risers, preferably with a subsea well control device attached to the lower end of the riser string, from the working deck in the firing line.

2. Description of Background Art

Such offshore vessels comprising a heave compensated hoist system supported by a mast having a working deck provided over the moonpool are generally well known. The working deck is used to handle risers, which are connected and lowered by the hoist system to form a riser string. The heave compensated hoisting device is used to provide heave compensation for loads suspended from the travelling block.

The riser string, connected subsea well control device, and optionally connected well entry equipment form a stiff entity extending between the vessel and the bottom of the sea. Therefor, generally a riser tensioner is provided to manage the differential movements between the riser string and the vessel. If there were no riser tensioner and the vessel moves downward, the riser string would buckle; if the vessel rises then high forces would be transmitted to the riser string and it would stretch and be damaged. The riser tensioner may be a direct acting riser tensioner device, or to a riser tensioner ring of a cable type riser tensioner system is arranged on board of the vessel. As is known in the art these procedures may include the attachment of a slip joint or telescopic joint to the top end of the riser string.

Hence, it is common to provide a riser tensioner as a primary heave compensator between the vessel and the riser string, and use the heave compensation system associated with the hoisting device as auxiliary heave compensator when well entry equipment is to be attached to the riser string. For example, the injector head of a coiled tubing installation is connected to the heave compensated travelling block.

A disadvantage of such a vessel is that in order to operate the injector head, personnel needs to be brought at the level of the travelling block, generally using tuggers etc. This operation is disadvantageous.

SUMMARY OF THE INVENTION

The aim of the invention is to provide an improved vessel. According to the present invention, a heave compensation connection system is provided, which is adapted to connect the working deck to the travelling block, such that the hoisting device can move the working deck when the working deck is connected to the travelling block between a lowered riser assembly position allowing the assembly of a riser string, and in which the working deck is supported by the hull, and a raised heave compensated position, in which the working deck is connected to the travelling block, and wherein the working deck is heave compensated, e.g. to perform well entry operations and/or subsea well control device installation.

The advantage of such a vessel is that the heave compensation system associated with the hoisting device can optionally be used to heave compensate the working deck.

According to a possible embodiment, the offshore vessel further comprises well entry equipment. In this possible embodiment, the working deck is capable of supporting at least part of the well entry equipment, such as an injector head, preferably a coiled tubing injector head. In this embodiment, the heave compensation connection system allows the working deck on which the (part of) the well entry equipment is positioned to be connected to the travelling block, such that it is possible to raise the working deck with the (part of) the well entry equipment to the raised heave compensated position. As such, it is possible to heave compensate the stiff entity of (part of) well entry equipment, riser string and subsea well control device.

Commonly, the heave compensation system associated with the hoisting device operates in combination with the heave compensation provided by the riser tensioner. However, in a possible embodiment, it is also conceivable that the heave compensation system associated with the hoisting device can compensate the heave of the entire load: riser string and subsea well control device, and optionally attached (part of) the well entry equipment. In this embodiment the riser tensioner can optionally be removed.

Advantageously, the heave compensated working deck can also be used to lower a riser string with attached subsea well control device on the bottom of the sea, to perform subsequent operations, such as drilling operations.

The invention further relates to a well entry operation.

The offshore vessel according to the invention is capable of installing and removing a subsea well control device and a riser string. The subsea well control device is a device to be disposed on top of the subsea well, on the seafloor, which may also generally be referred to as a wellhead. The offshore vessels are also suitable for well entry operations, such as well interventions, e.g. coiled tubing operations and wirelining, e.g. for introducing chemical components into the well, or to perform measurements in the well, such as temperature and/or pressure measurements.

The offshore vessel according to the invention is preferably a monohull vessel, wherein a moonpool is provided in the hull of the vessel. It is also conceivable that the invention is installed on a vessel comprising a catamaran hull having the moonpool between the hulls.

On the hull of the vessel a mast is provided having a top side and a base connected to the hull of the vessel. The mast is provided above or adjacent the moonpool. A hoisting device is supported by the mast for raising and lowering a load, such as a subsea well control device, a riser string optionally connected to the subsea well control device, or the assembly of injector head, riser tensioner and subsea well control device. The hoisting device comprises a travelling block for connecting the load to the hoisting device. The travelling block preferably comprises a pipe clamp, also referred to as an elevator, to connect pipe sections to the travelling block. The travelling block is displaceable along a firing line which extends through the moonpool. It is possible that the firing line is located adjacent the mast, as is common for closed hollow masts which is a common product from the applicant. In a preferred embodiment, a multiple firing line hoist system may be provided, comprising a second hoisting device operating in a second firing line. A mast has a closed box-like design with the firing line(s) located outside. Through the chosen construction, in which the mast forms a tube with space on the inside, there is generally sufficient space available in the mast on a drilling vessel or similar vessel for hoisting equipment to be advantageously placed inside the mast. Control elements of the hoisting device that can be accommodated in the mast itself are e.g. hydraulic lines, motors, winches, cylinders for the heave compensation system and the like. Since the control elements of the hoisting blocks are accommodated in the mast itself, the outside of the mast is very easy to reach. The accessibility of the mast is not restricted by a lattice structure, and there are no cables, lines or other obstacles which restrict the accessibility. This means that hoisting equipment will not require any additional space. In addition to the space-saving advantage which this produces, it is important that the mast remains freely accessible from all sides due to the hoisting equipment being located inside the mast, and the firing line is freely accessible from three sides (all except where the mast is located). A great deal of precious space is consequently kept free on deck of the ship. The heave compensation system therefore does not present any obstacle to feeding tools to the mast.

The hoisting device comprises preferably at least one hoisting winch and a hoisting cable associated with the at least one hoisting winch. Alternatively, the hoisting device may comprise a cylinder, or a rack and pinion, etc.

The vessel is further provided with a heave compensation system, associated with the hoisting device, for damping the effect of the movement of the vessel as a result of sea-state induced vessel motion on the load attached to the travelling block. In general, the heave compensation system is suitable to compensate for displacements of up to 15 meters, and for loads up to 800 tons.

The heave compensation system may comprise an active heave compensation mechanism and/or a passive heave compensation mechanism. In an embodiment comprising both heave compensation mechanisms, in the raised heave compensated position the working deck can be active heave compensated or passive heave compensated, as desired.

In an embodiment according to the present invention, the working deck is active heave compensated while installing the subsea well control service onto the bottom of the sea, and wherein the working deck is passive heave compensated when the subsea well control service has been installed on the bottom of the sea.

The heave compensation system preferably comprises one or more cylinders to provide active and/or passive heave compensation. Alternatively, or additionally, the heave compensation system comprises an electronic system for detecting heave and for activating the hoisting device to provide active heave compensation.

Such offshore vessels are generally provided with a working deck which covers at least a portion of the moonpool, in particular a portion of the moonpool through which the firing line extends, thus adjacent the mast when the firing line is adjacent the mast, or below the mast when a derrick-type of mast is applied. The working deck is provided with an opening through which the firing line extends, such that the hoisting device can raise and lower a load, such as a riser string, preferably with a subsea well control device attached to the lower end of the riser string, through the opening in the working deck. The working deck is supported by the hull of the vessel.

The working deck is provided with a riser string suspension device, that allows to suspend a top end of a string of risers, preferably with a subsea well control device attached to the lower end of the riser string, from the working deck in the firing line. This riser string suspension device of the working deck preferably includes a clamping device or similar to suspend a string of risers from the working deck, such as for example a device known as a riser spider, or alternatively a rotary table.

According to the present invention, the vessel comprises a heave compensation connection system to connect the working deck to the travelling block. As described above, known working decks are supported by the hull, allowing the assembly of a riser string. This lowered position is further referred to as the lowered riser assembly position.

When, according to the present invention, the working deck is connected to the travelling block with the heave compensation connection system, the hoisting device can raise and lower the working deck, to move the working deck between the lowered riser assembly position and a raised heave compensated position. In this heave compensated position the working deck is connected to the travelling block, and the working deck is heave compensated to perform well entry operations. It is noticed that with a vessel according to the invention, the hoisting device may raise the working deck to a range of raised positions, preferably heave compensated positions. The lowermost heave compensated position may be relatively close to the riser assembly position, while the highest heave compensated position may be relatively close to the topside of the mast. In any position, the working deck should be able to move in the entire range of heave compensation displacement, which may be up to 15 meters, as indicated above. It is conceivable that the working deck is raised to a raised position, in which no heave compensation is possible.

According to a possible embodiment, the hoisting device can raise the working deck to a raised subsea well control service installation position wherein the subsea well control device can be brought underneath the working deck into the firing line and manipulated by the hoisting device. Possibly, a subsea well control device storage is provided on the same level as the lowered riser assembly position of the working device. It is then preferred that the raised subsea well control service installation position of the working deck is raised sufficiently for the subsea well control device to move on the same level from the subsea well control device storage to the firing line. This movement can e.g. be established by the provision of rails on deck, trolleys, auxiliary frames, etc. etc.

According to a possible embodiment, the heave compensation connection system is adjustable in length to adjust the distance between the travelling block and the working deck connected thereto, and comprises e.g. cables, chains, rigid beams, etc. etc. For example, a relatively short distance between working deck and travelling block is required when no structural parts extend between the working deck and the travelling block. Alternatively, an increased distance between working deck and travelling block may be required when an injector head for performing well entry operations is positioned on top of the working deck, between the working deck and the travelling block.

The invention also relates to a method of operation of an offshore vessel, wherein the hoisting device raises the working deck to a raised heave compensated position, in which position the working deck is heave compensated, e.g. to perform well entry operations and/or to lower the subsea well control device.

Possibly, the method comprising the steps:

- bringing the subsea well control device underneath the working deck into the firing line;
- lowering both the subsea well control device and the working deck with the hoisting device;
- assembling and connecting riser parts to the subsea well control device and to each other to form a riser string extending between the subsea well control device and the vessel, wherein the travelling block is used to lower the riser string and suspended subsea well control device;
- installing the subsea well control device on the bottom of the sea.

In particular, the following steps can be included

- connecting the working deck to the travelling block;
- raising the working deck;
- bringing the subsea well control device underneath the working deck into the firing line and connecting the subsea well control device to the travelling block or to the riser string suspension device of the working deck;
- lowering both the subsea well control device and the working deck with the hoisting device until the working deck is at its lowermost position in which it is supported by the hull;
- optionally connecting the subsea well control device to the riser string suspension device of the working deck and disconnecting the subsea well control device from the travelling block;
- disconnecting the working deck from the travelling block;
- assembling and connecting riser parts to the subsea well control device and to each other to form a riser string extending between the subsea well control device and the vessel, wherein the travelling block is used to lower the riser string and suspended subsea well control device;
- connecting the working deck to the travelling block;
- raising the working deck to a raised heave compensated position;
- installing the subsea well control device on the bottom of the sea providing heave compensation using the heave compensation system.

It is also conceivable that a riser tensioner is provided, which is attached to the top end of the launched riser string. This riser tensioner may also be allowed to provide heave compensation when installing the subsea well control device on the bottom of the sea.

Possibly, the method further comprises the steps of:

- installing a riser tension ring onto the riser string;
- installing (part of) the well entry equipment on the working deck, below the travelling block;
- raising the working deck with the (part of) the well entry equipment to the raised heave compensated position.

BRIEF DESCRIPTION OF THE DRAWINGS

The invention is further elucidated in relation to the drawings, in which.

DETAILED DESCRIPTION OF THE INVENTION

Figure 1:
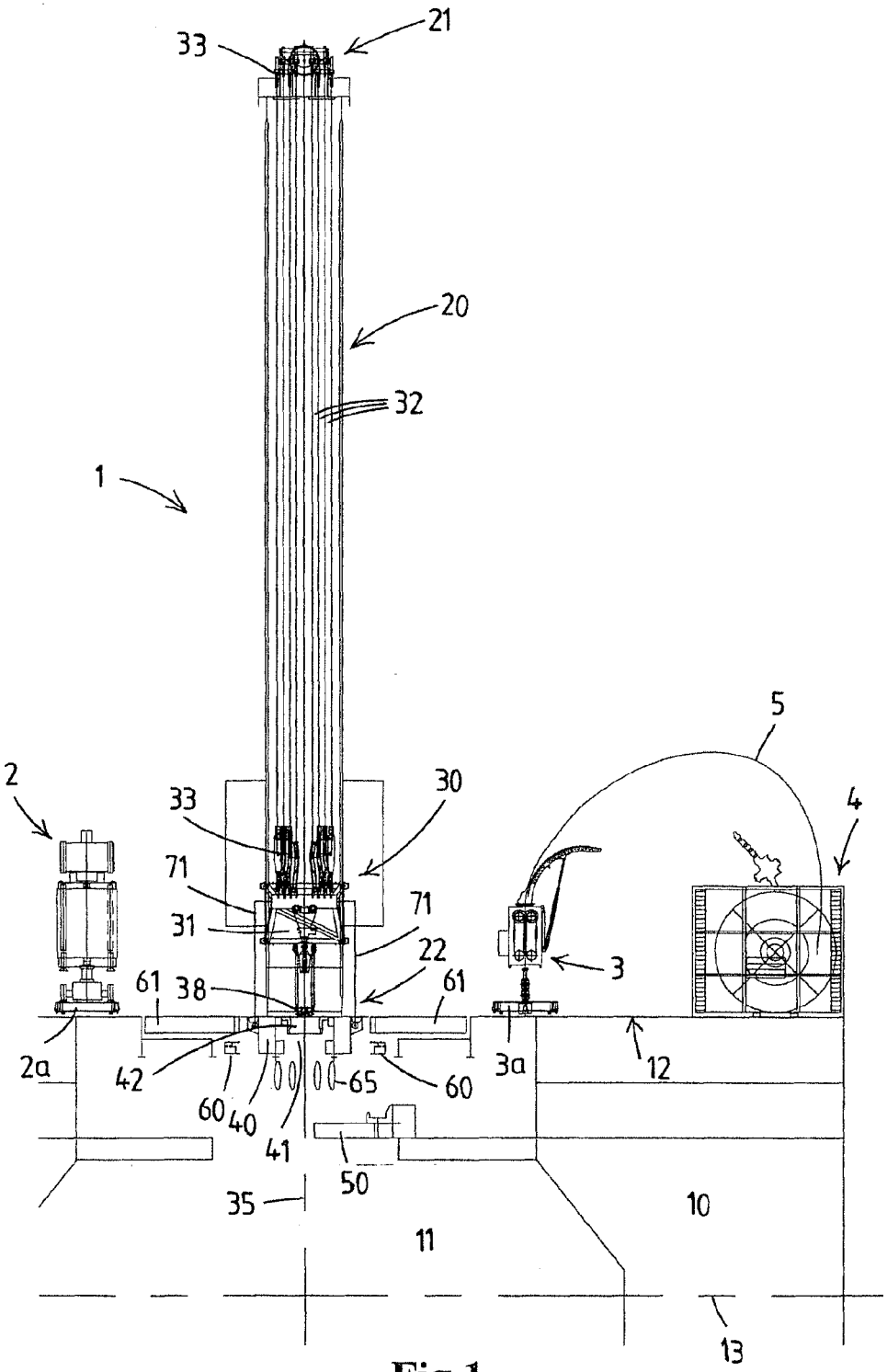
FIG. 1 schematically depicts in a side view part of an offshore vessel according to the present invention, wherein the working deck is in its lowered riser assembly position.

In FIGS. 1-15 a schematical side view of a part of an offshore vessel 1 according to the present invention is shown, which is capable of installing and removing a subsea well control device 2 and a riser string, and of performing well entry operations with well entry equipment 3, 4. The side view of FIG. 1 corresponds to the view of FIGS. 2-11, 12*b*, 13*b*, 14, 15*a* and 15*b*. In the side views of FIGS. 12*a* and 13*a* some parts may be visible, or visible more clearly. As all figures are related to the same embodiment, the same numbering is applied in all drawings.

The offshore vessel 1 comprises a hull 10 in which a moonpool 11 is provided, and a deck 12. The waterline is schematically indicated with dotted line 13. A mast 20 having a top side 21 and a base 22 is connected to the hull 10 of the vessel 1, which mast 20 is provided above the moonpool 11.

A hoisting device 30 is supported by the mast 20 for raising and lowering a load, such as a riser string. The hoisting device comprises a travelling block 31 to connect the load to the hoisting device. Here, the travelling block comprises a pipe clamp 38, also referred to as an elevator, to connect pipe sections to the travelling block. In this embodiment, the hoisting device 30 further comprises cables 32, pulleys 33 and winches 34 (see FIG. 12*a*). The travelling block 31 is displaceable along a firing line 35, schematically indicated in dotted lines, through the moonpool 11.

In the shown embodiment, the subsea well control device 2 is positioned on a trolley 2*a* on deck 12 of the vessel. The well entry equipment in this embodiment comprises a coiled tubing injector head 3, positioned on a trolley 3*a* on deck 12, and a coiled tubing spool 4 positioned on deck. The coiled tubing 5 extends between the coiled tubing spool 4 and the coiled tubing injector head 3.

A working deck 40 is provided, in FIG. 1 supported by the hull of the vessel, covering a portion of the moonpool 11. The firing line 35 extends through an opening 41 in said working deck 40. The working deck 40 is provided with a riser string suspension device 42 that allows to suspend a top end of a string of risers; in this embodiment the riser string suspension device 42 is in the form of a rotary table.

In the moonpool 11, also a moonpool skid cart 50 is visible, which is movably supported by the hull of the vessel. The moonpool skid cart 50 is capable of supporting the riser string and attached subsea well control device in the firing line, and can be retracted from the firing line when desired.

In the moonpool 11, also a riser tensioning ring 60 is provided. In the situation shown in FIG. 1, two parts of the riser tensioning ring 60 are visible, which are supported by hatches 61 and which are moved apart to allow the working deck 40 to be positioned between the riser tensioning ring parts. Finally, in the moonpool 11, sheaves 65 are visible which, after installation of connecting cables can cooperate with the riser tensioning ring 60 to form a riser tensioner to manage the differential movements between the riser string and the vessel.

According to the invention, a heave compensation connection system is provided between the working deck 40 and the travelling block 31. In this embodiment, the heave compensation connection system comprises cables 71 between the working deck 40 and the travelling block 31. In addition, in this embodiment, as visible in FIG. 12*a*, a trolley 72 is provided adjacent the mast to guide the working deck 40 along the mast 20 when the hoisting device 30 moves the working deck along the mast 20 between a lowered riser assembly position, and a raised heave compensated position.

In FIG. 1, the working deck 40 is situated in the lowered position, in which it is supported by the hull. The cables 71 of the heave compensation connection system have already been attached to the working deck 40 and the travelling block 31.

Figure 2:
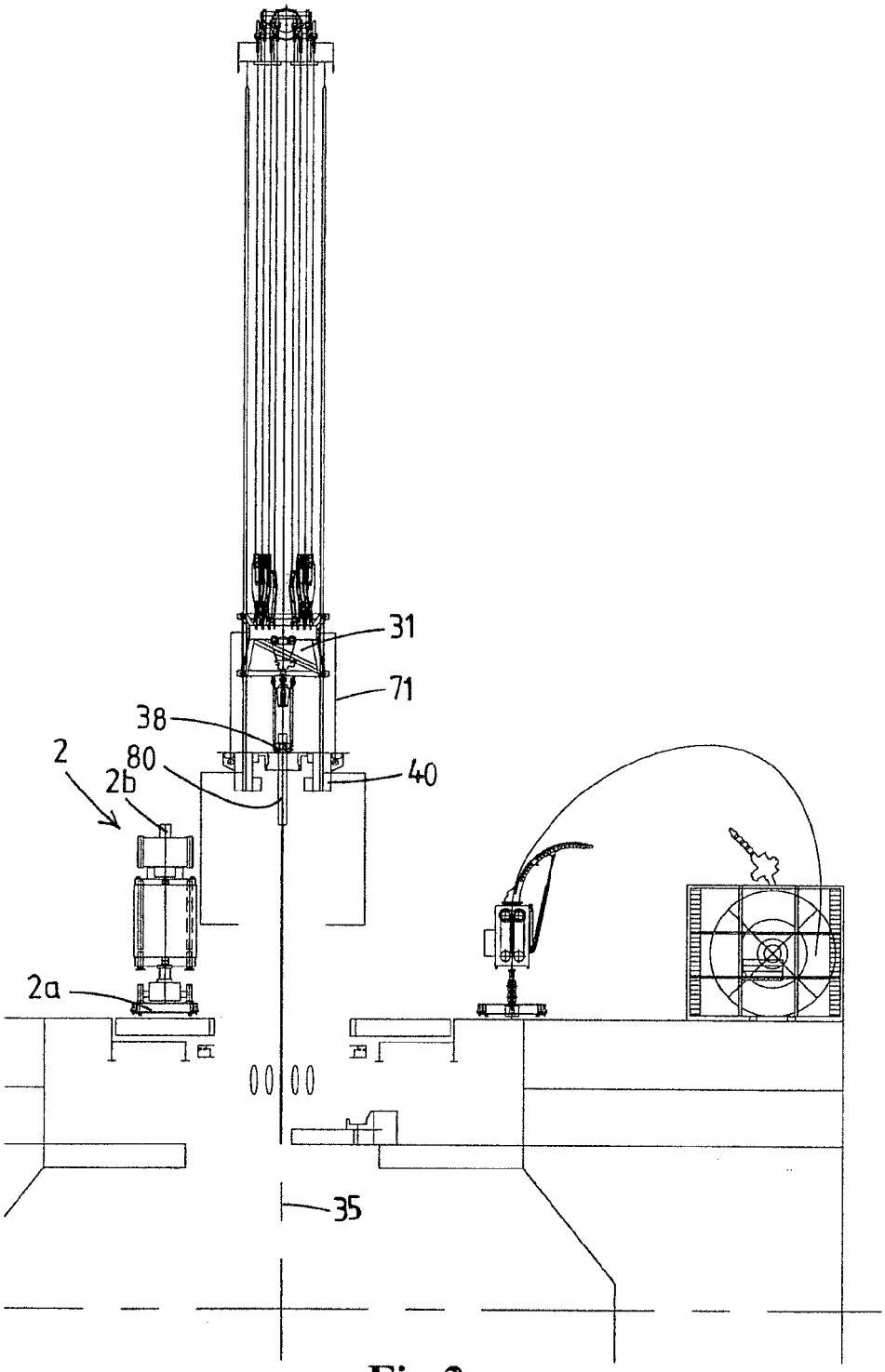
FIG. 2 shows the embodiment of FIG. 1, wherein the working deck is in a raised position, allowing the positioning of a subsea well control device.

In FIG. 2, the hoisting device 30 has lifted the travelling block 31 and the working deck 40 to a raised position. In the raised position of FIG. 2, the subsea well control device 2 can be brought underneath the working deck 40, into the firing line 35, here via trolley 2*a* and over hatches 61. A riser part 80 is connected in pipe clamp 38 of the travelling block 31, which riser part 80 can be connected to a pipe end part 2*b* of the subsea well control device 2. Alternatively, the riser part 80 is connected to the riser string suspension device 42 of the working deck 40.

Figure 3:
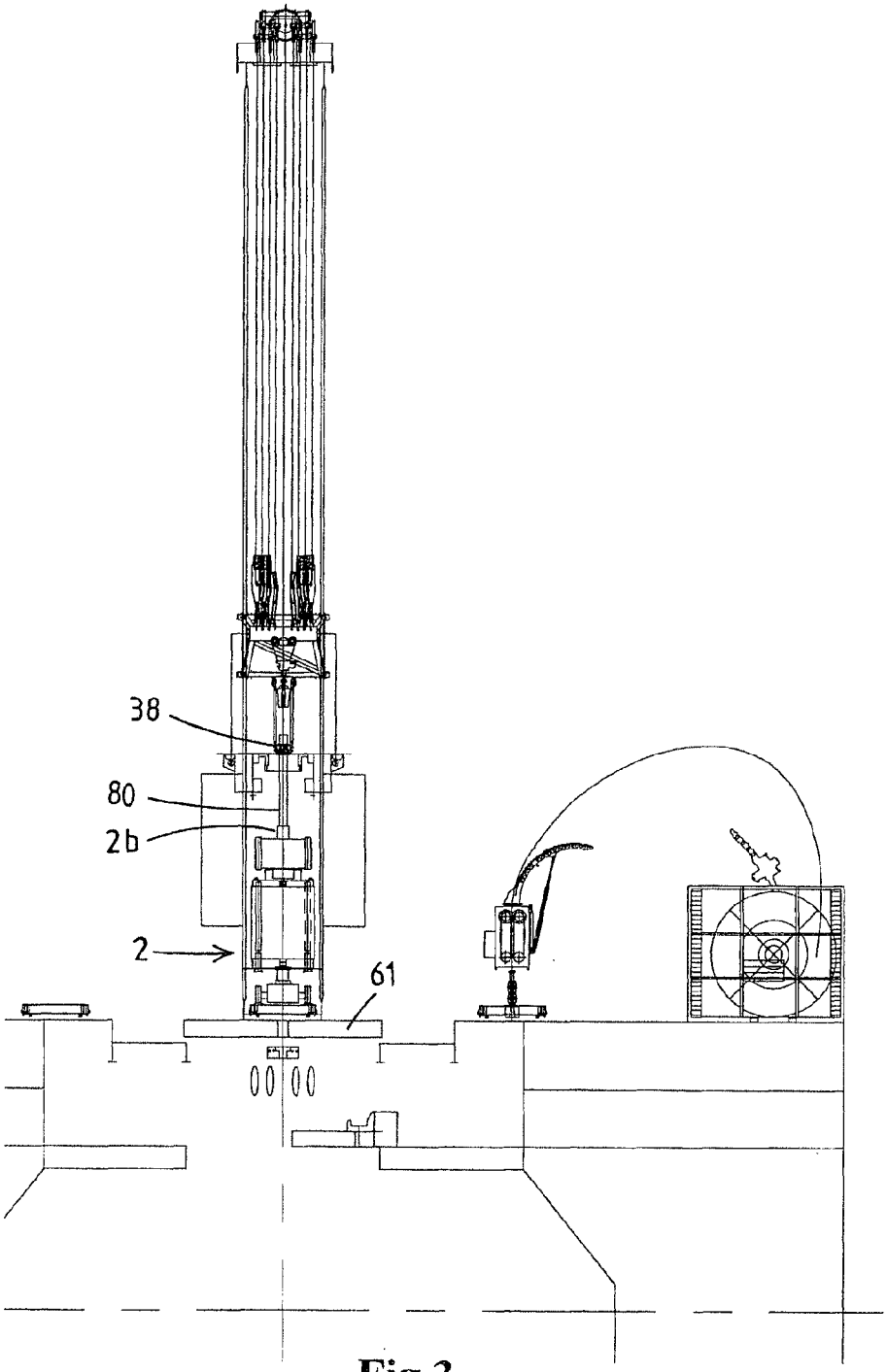
FIG. 3 shows the embodiment of FIG. 1, wherein the subsea well control device is connected to the hoisting device (or to the working deck)

This is shown in FIG. 3: subsea well control device 2 is connected via its pipe end part 2*b* and the riser part 80 to the pipe clamp 38 of the travelling block 31. It is also conceivable that at this stage the subsea well control device 2 is connected via its pipe end part 2*b* and the riser part 80 to the riser string suspension device 42 of the working deck 40. In absence of the working deck 40, it is possible to move hatches 61 towards each other above the moonpool, and hence to support the subsea well control device 2 in the firing line 35 while attaching the pipe end part 2*a* to the riser part 80.

Figure 4:
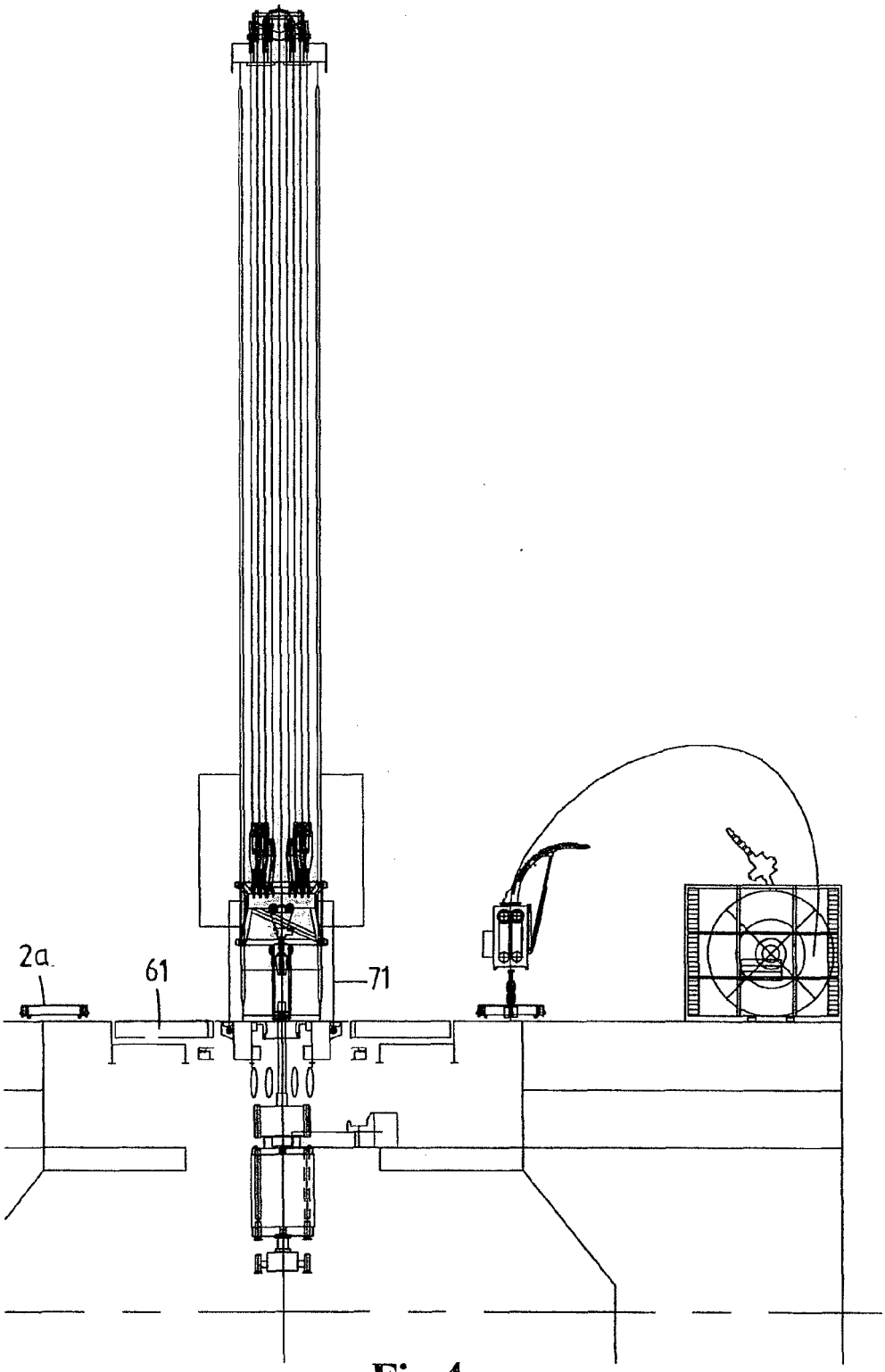
FIG. 4 shows the embodiment of FIG. 1, wherein the subsea well control device is lowered into the moonpool and the working deck is lowered to its lowered riser assembly position.

Once the subsea well control device 2 is connected to the hoisting device 30, the hatches 61 are allowed to move out of the firing line, the trolley 2*a* is allowed to move away and the subsea well control device 2 can be lowered through the moonpool, in the firing line, by the hoisting device, until the working deck 40 arrives at its lowermost position, in which it is supported by the hull. This is shown in FIG. 4. In a possible operation, the riser part 80, which is connected to the pipe end part 2*a* of the subsea well control device 2 is now connected to the riser string suspension device 42 of the working deck 40, and disconnected from the travelling block. It is also conceivable that this riser part 80 was connected to the working deck 40 at an earlier stage.

Figure 5:
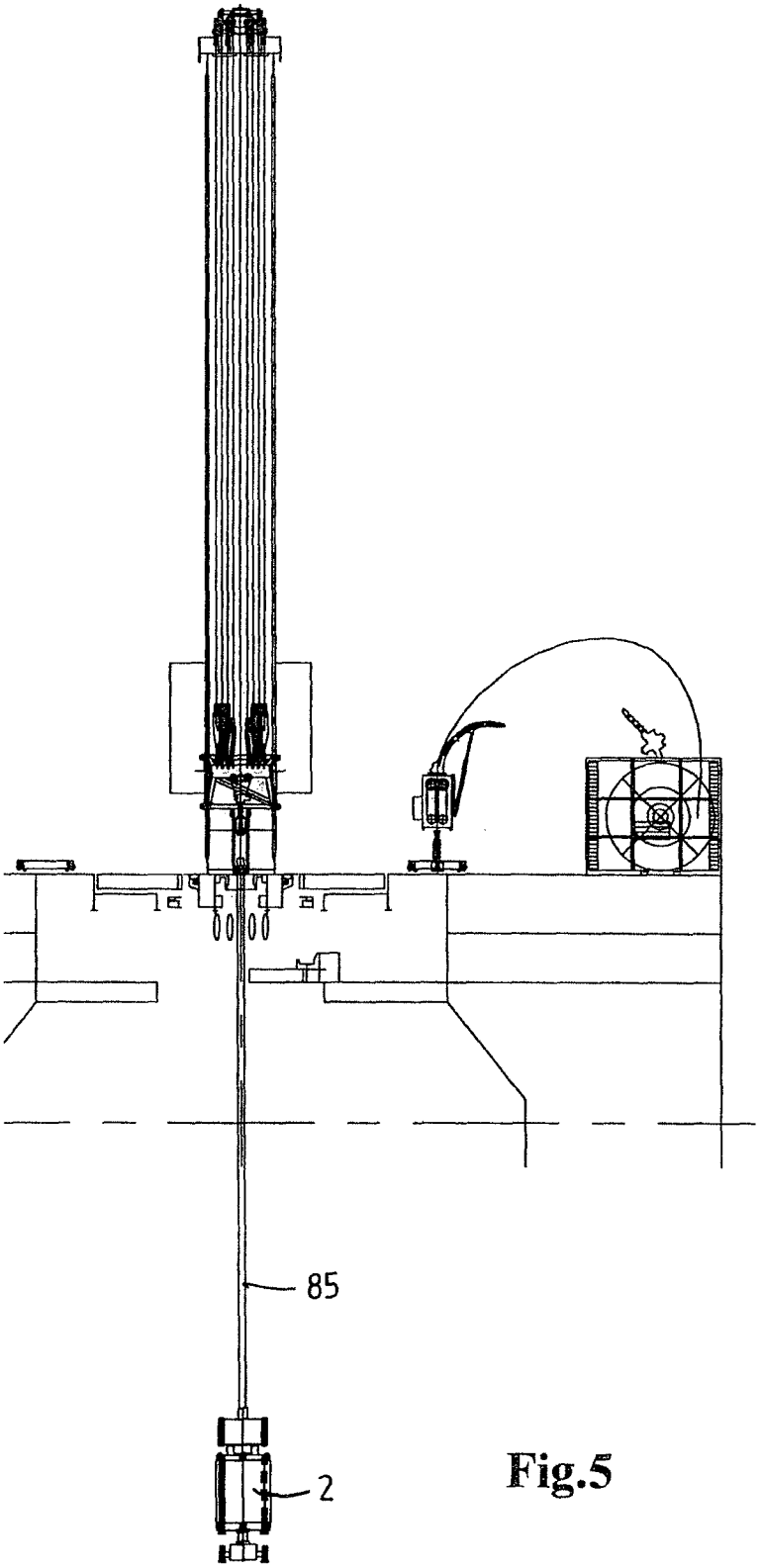
FIG. 5 shows the embodiment of FIG. 1, wherein a riser string has been attached to the subsea well control device.
Figure 6:
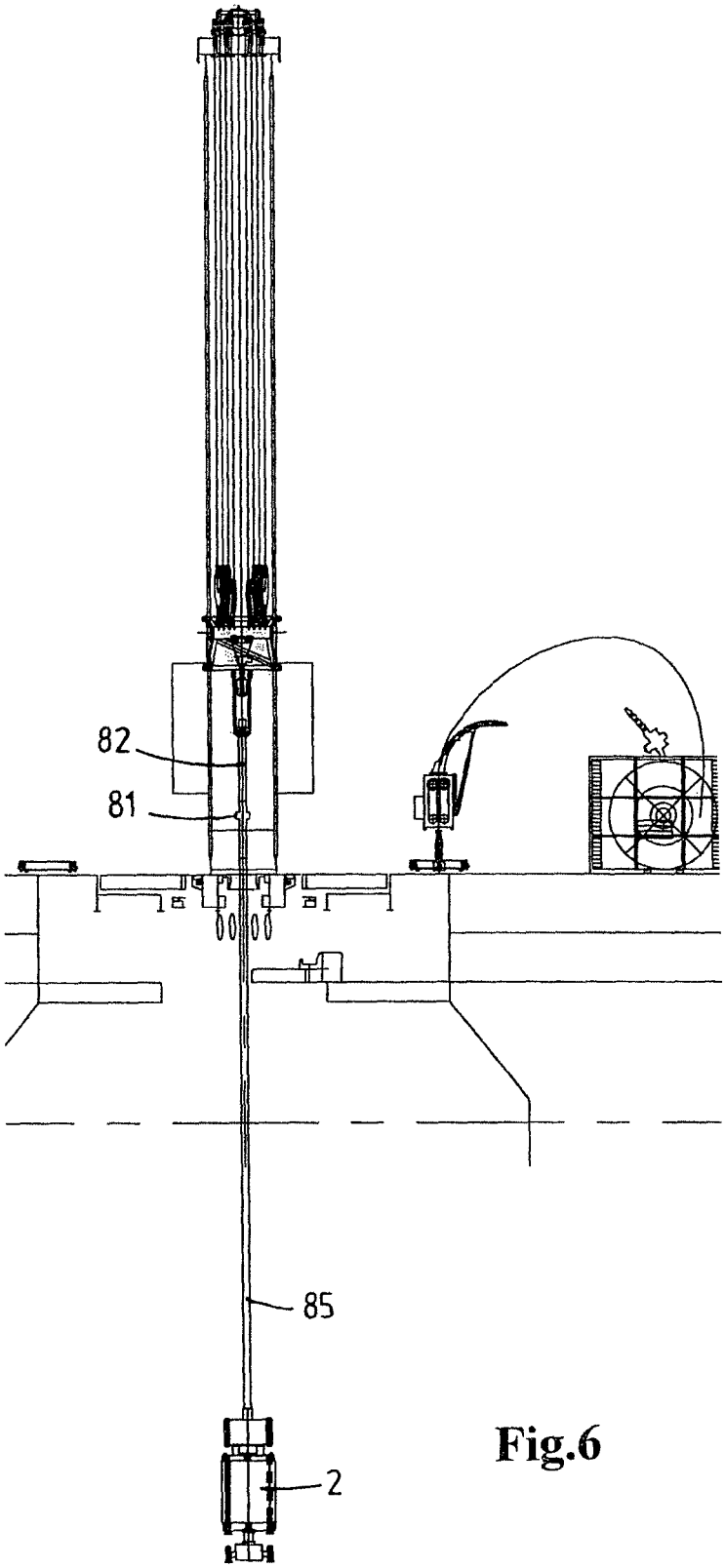
FIG. 6 shows the embodiment of FIG. 1, wherein a specific riser tensioning part is installed into the riser string.

In the position of FIG. 4, the heave compensation connection cables can be disconnected from the working deck 40 and the travelling block 31. Once disconnected, the situation of FIG. 5 is achieved in which the working deck is in its lowered riser assembly position allowing the assembly of a riser string from individual riser parts. While the launched riser string 85 with at its lower end the subsea well control device 2 is suspended by the working deck 40, a subsequent riser part is allowed to enter the firing line above the working deck, above the launched riser string. This riser part is connected to the top of the launched riser string and clamped by the travelling block 31. Then the riser string is lowered by the hoisting devictraae until the top end of the last installed riser part is at a position to be suspended by riser string suspension device 42 of the working deck 40.

Figure 7:
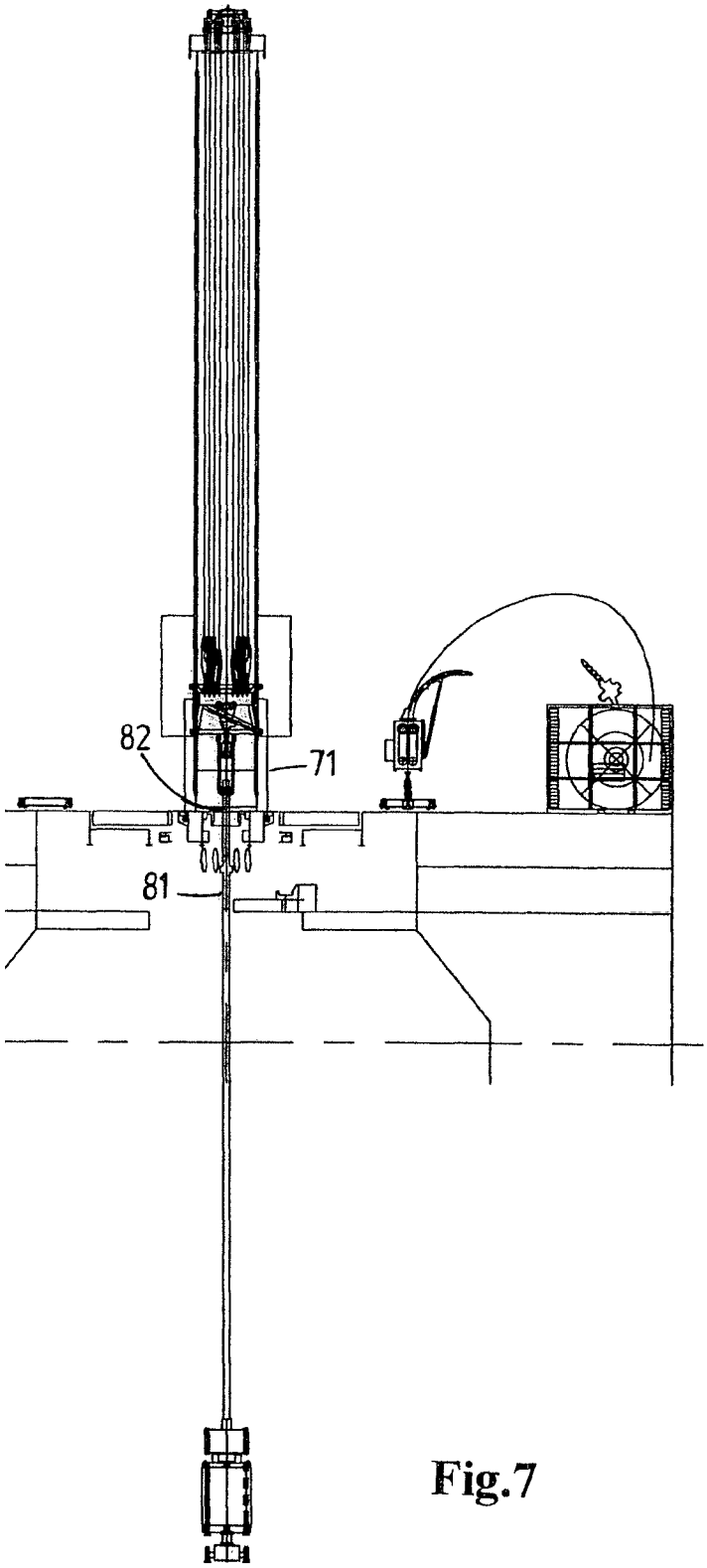
FIG. 7 shows the embodiment of FIG. 1, wherein the working deck is connected to the travelling block.
Figure 8:
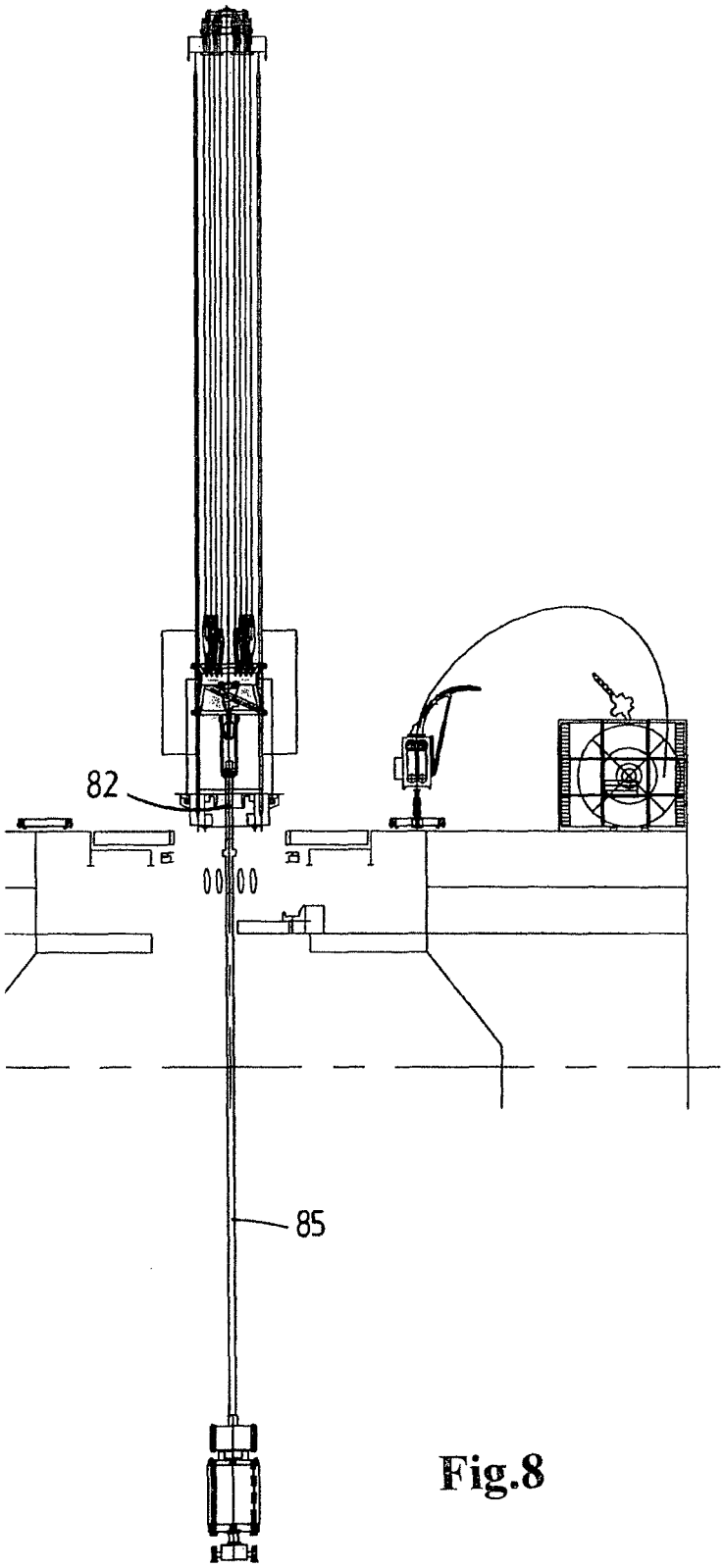
FIG. 8 shows the embodiment of FIG. 1, wherein the working deck and launched riser string are raised to a position allowing the engagement of a riser tensioning ring on the specific riser tensioning part.
Figure 9:
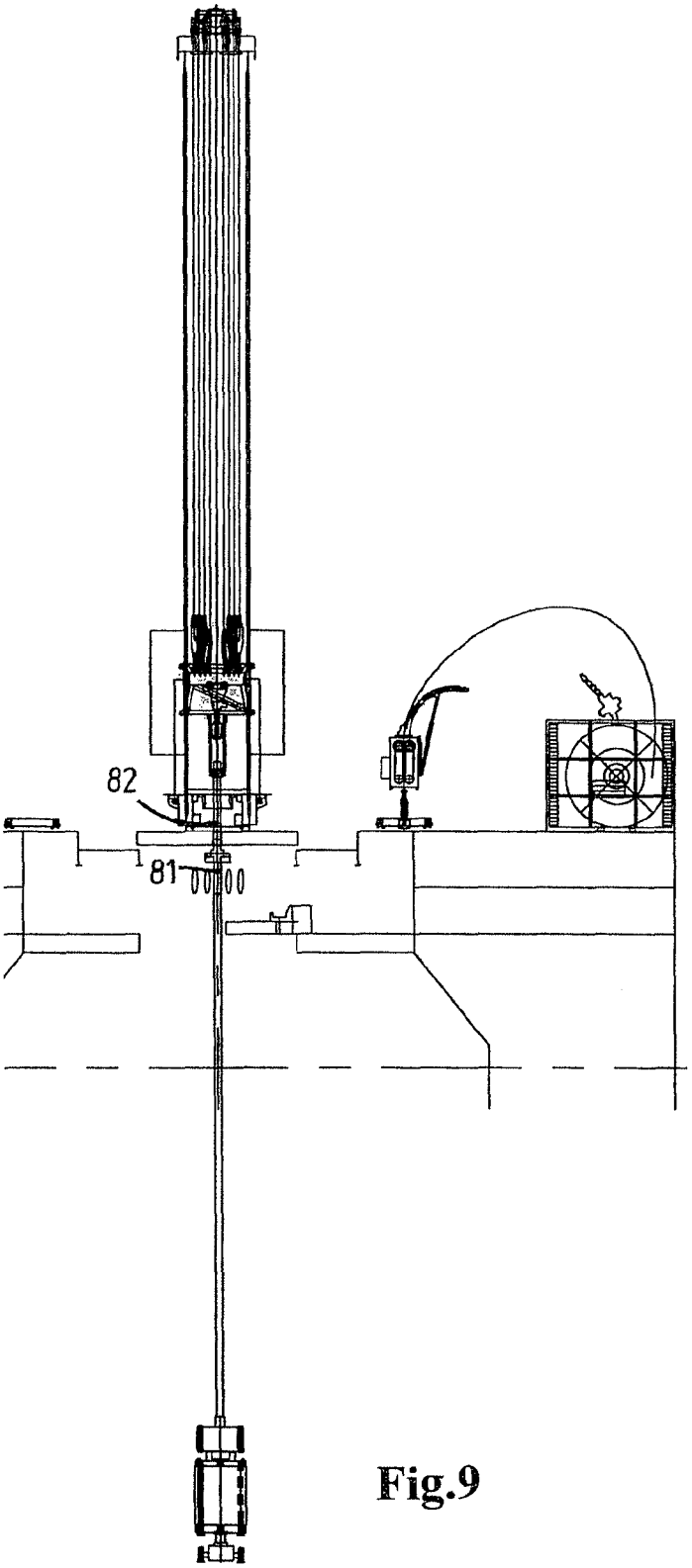
FIG. 9 shows the embodiment of FIG. 1, wherein the riser tensioning ring has engaged on the specific riser tensioning part.

Once the launched riser string 85 is in the vicinity of the bottom of the sea, a riser tensioning part 81 and an auxiliary riser part 82 are installed above the launched riser string 85. This riser tensioning part 81 has riser tensioning ring engagement portions, which can engage with the riser tensioning ring 60. This special riser tensioning part is visible in FIG. 6 above the launched riser string 85. In FIG. 7 the riser tensioning part 81 has been lowered to a position below the working deck 40. In this position, the working deck 40 is again connected to the travelling block 31 via cables 71. The launched riser string 85 may be supported by the working deck 40, or alternatively by the travelling block 31. In FIG. 8, it is visible that the launched pipeline 85 and the working deck 40 are raised a small distance, allowing the hatches 61 to move towards each other over the moonpool, and allowing the parts of the riser tensioning ring 60 to move towards each other and to the riser tensioning part 81. in FIG. 9, it is visible that the riser tensioning ring 60 engages the riser tensioning part 81 of the launched riser string 85.

Figure 10:
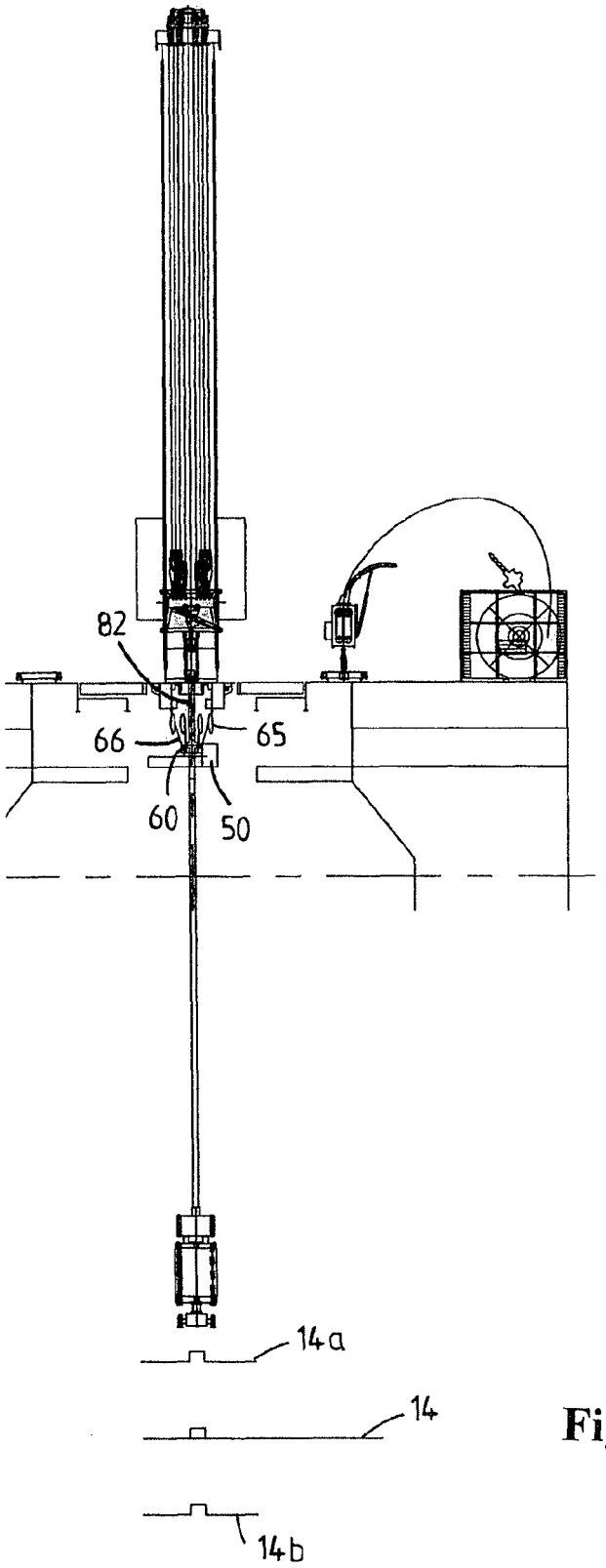
FIG. 10 shows the embodiment of FIG. 1, wherein a moonpool skid cart engages on the launched pipeline.

In FIG. 10, connecting cables 66 are provided connecting sheaves 65 and riser tensioning ring 60 to form a riser tensioner to manage the differential movements between the riser string and the vessel. In FIG. 10, the working deck 40 is lowered by the travelling block 31 to its lowermost position in which the working deck 40 is supported by the hull, allowing the disconnection of the heave compensation connection cables 71. In this lowered position, the moonpool skid cart 50 is allowed to engage the launched riser string 85, here at a position just below the riser tensioning ring 60. In FIG. 10, the bottom of the sea 14 is indicated. The distance between the vessel and the bottom of the sea may vary due to sea-state induced motions. This is schematically indicated in the drawing by indicating different sea bottom levels 14*a* and 14*b*. It is noted that in fact different vessel levels should have been drawn, but this would not make the drawings more legible.

Figure 11:
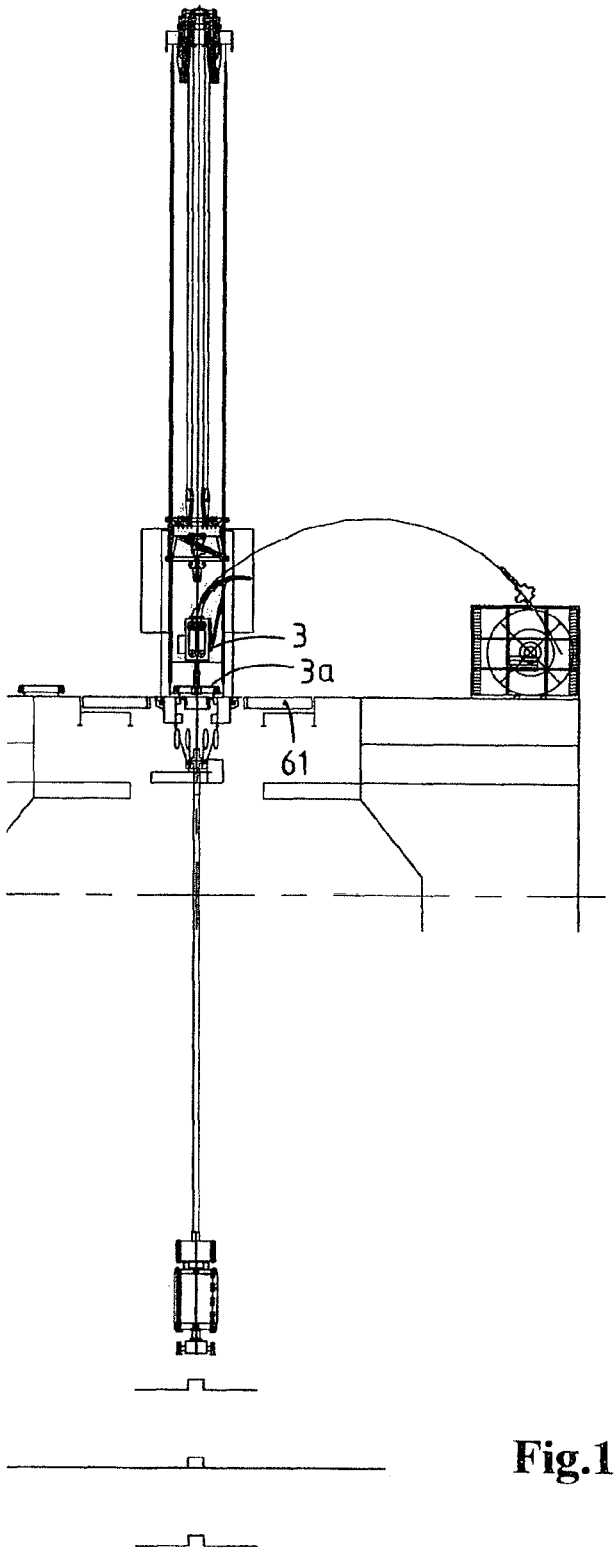
FIG. 11 shows the embodiment of FIG. 1, wherein a coiled tubing injector head is positioned on the working deck in the firing line.

In FIG. 11, the travelling block 31 is moved upward to a raised position. The auxiliary riser part 82 can now be disconnected to clear the firing line, allowing the coiled tubing injector head 3 to be brought between the working deck 40 and the travelling block 31, into the firing line 35, here via trolley 3*a* and over hatch 61. Once brought in position, the cables 71 of the heave compensation connection system can be attached to the working deck 40 and the travelling block 31.

Figure 12A:
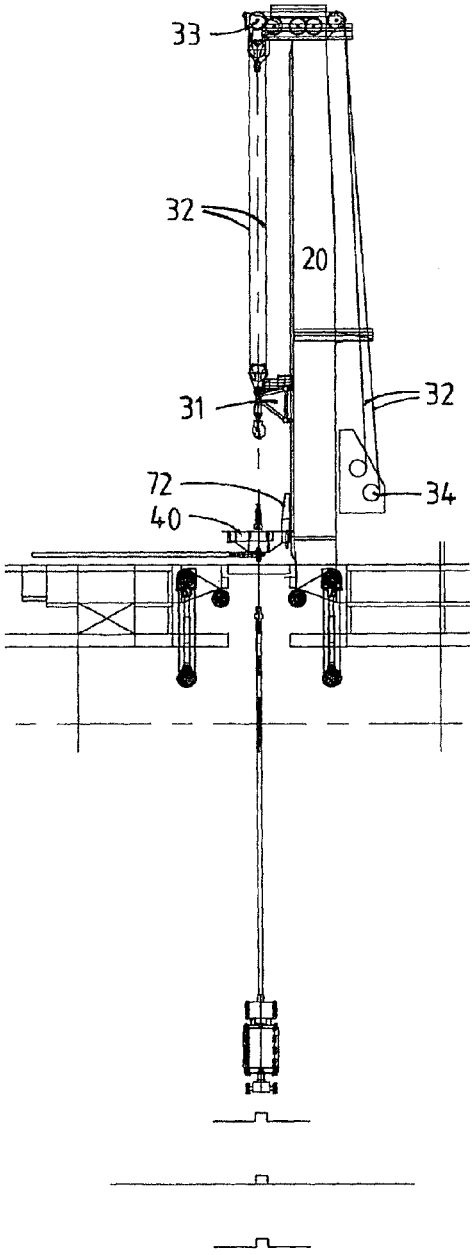
FIG. 12*a* shows the embodiment of FIG. 1 in a different view, wherein the working deck is in a raised position.
Figure 12B:
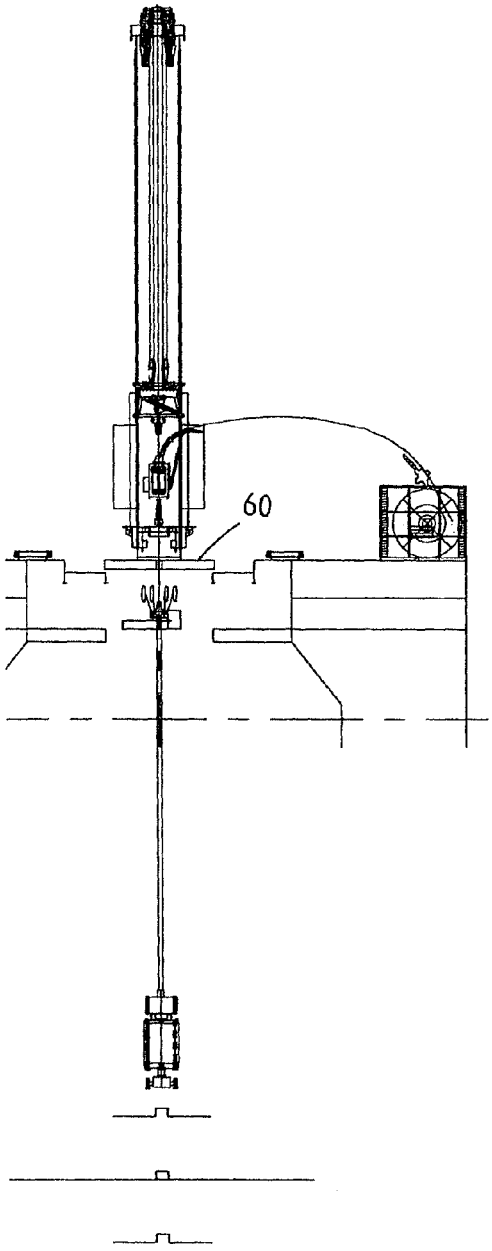
FIG. 12*b* shows the embodiment of FIG. 1, wherein the working deck with the coiled tubing injector head is in a raised position.

In FIGS. 12*a* and 12*b*, it is visible that the hoisting device 30 has lifted the travelling block 31 and the working deck 40 with the coiled tubing injector head 3 to a raised position, allowing the hatches 61 to cover the moonpool 11. The hoisting device 30 lifts the ensemble even further to the elevated position shown in FIGS. 13*a* and 13*b*.

Figure 13A:
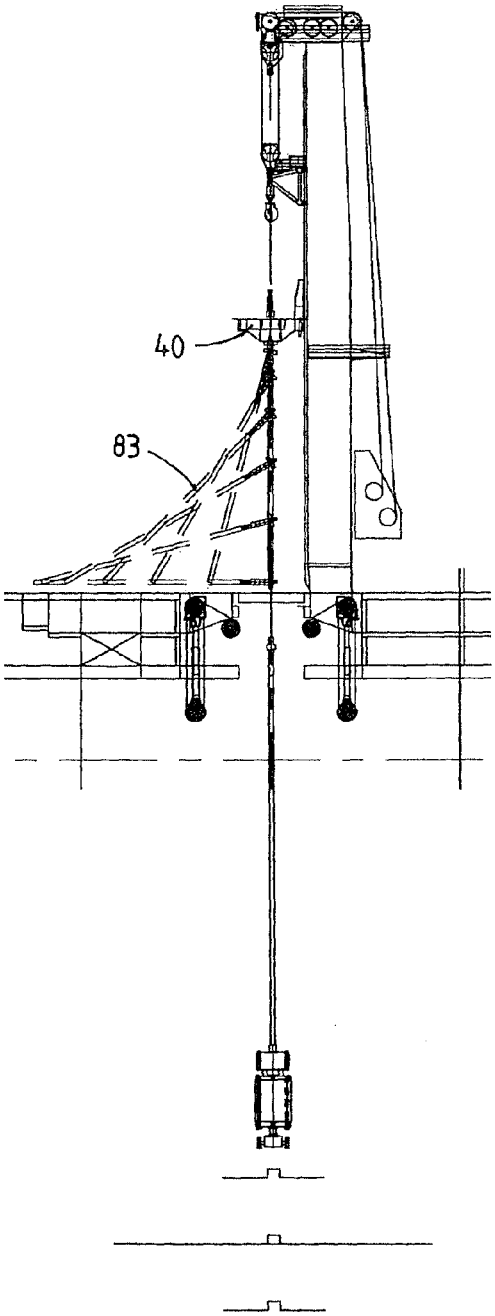
FIG. 13*a* shows the embodiment of FIG. 1 in the same view as FIG. 12*a*, in which an elongated riser part is brought in the firing line below the working deck, above the launched pipeline.
Figure 13B:
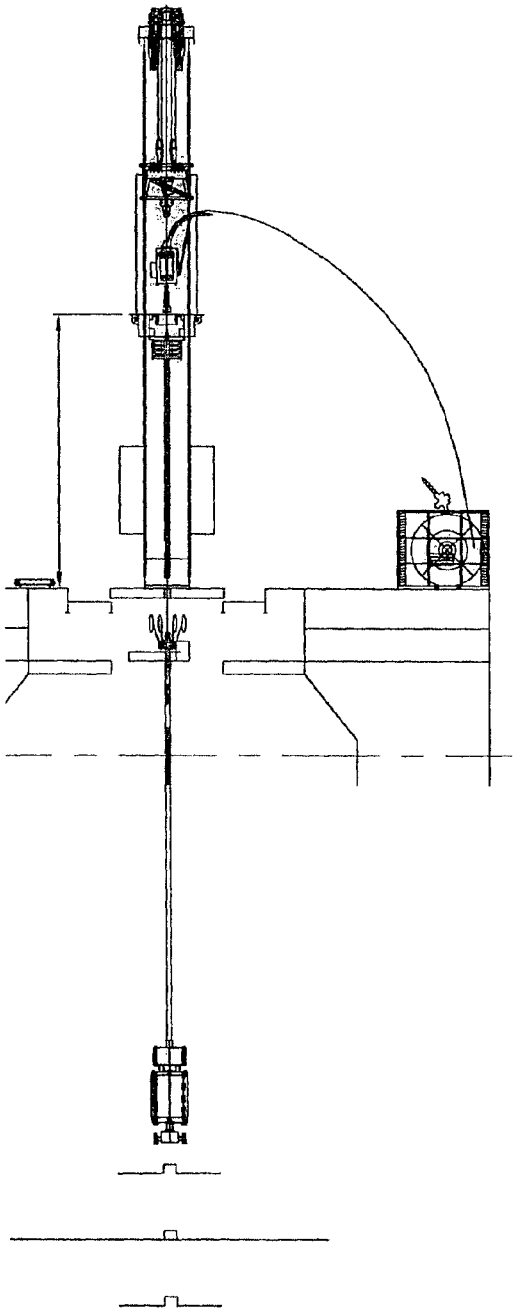
FIG. 13*b*. shows the embodiment of FIG. 1 in the same situation as shown in FIG. 13*a;*
Figure 14:
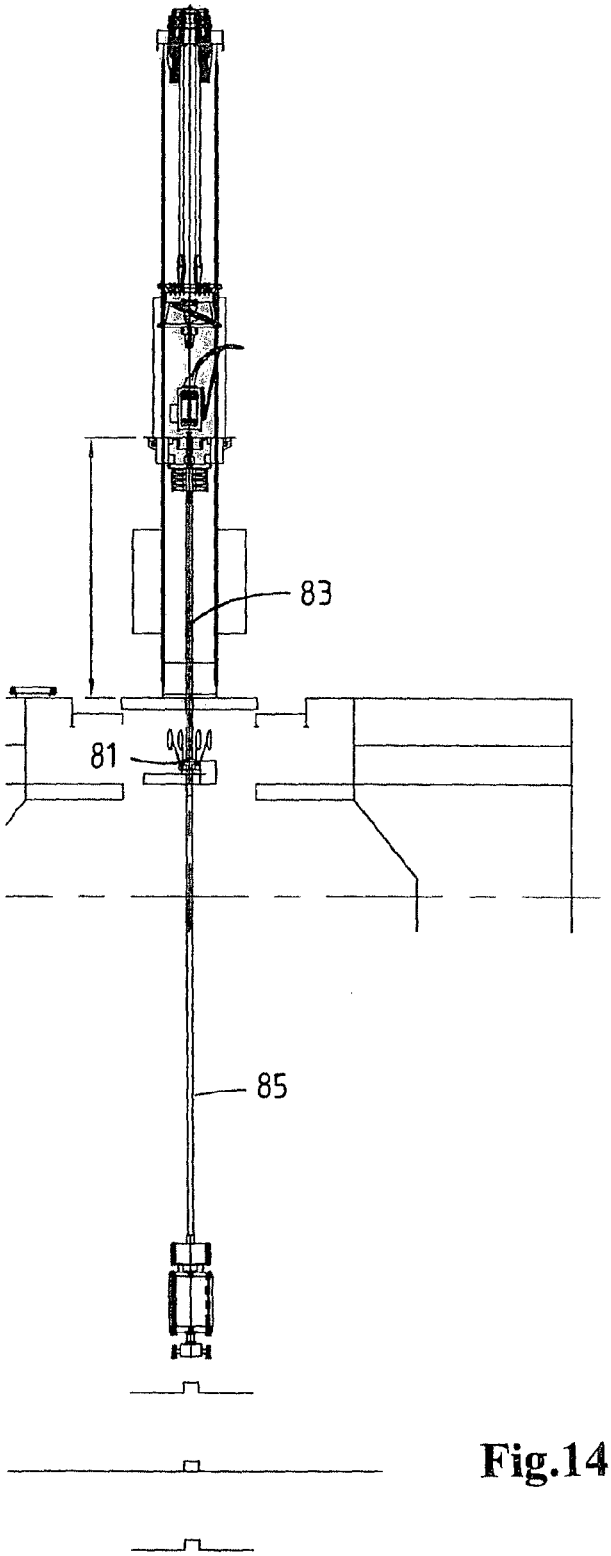
FIG. 14 shows the embodiment of FIG. 1, wherein the elongated riser part is connected to the launched pipeline.

In FIG. 13*a*, the erection of an elongated riser part 83 in the firing line 35, below the working deck is visible. Generally, the length of this elongated riser part 83 essentially corresponds to twice the desired heave compensation distance. This may be in the order of 10-15 meters. The elongated riser part 83 is connected to the riser string suspension device 42 of the working deck 40, and lowered together with the working deck as visible in FIG. 14 until it can be connected to the launched riser string 85, in particular to the upper riser tensioning part 81 thereof.

Figure 15A:
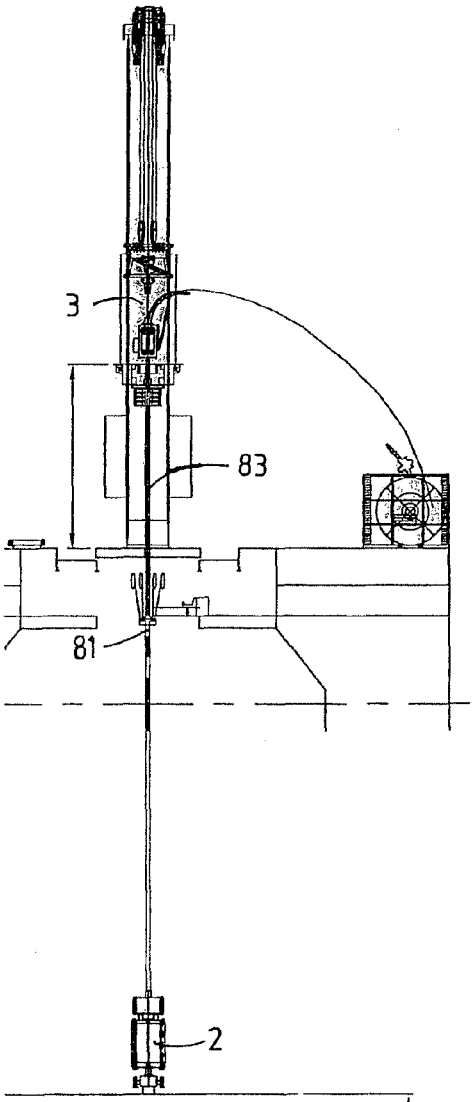
FIG. 15 shows the embodiment of FIG. 1, wherein the subsea well control device is installed on the bottom of the sea.
Figure 15B:
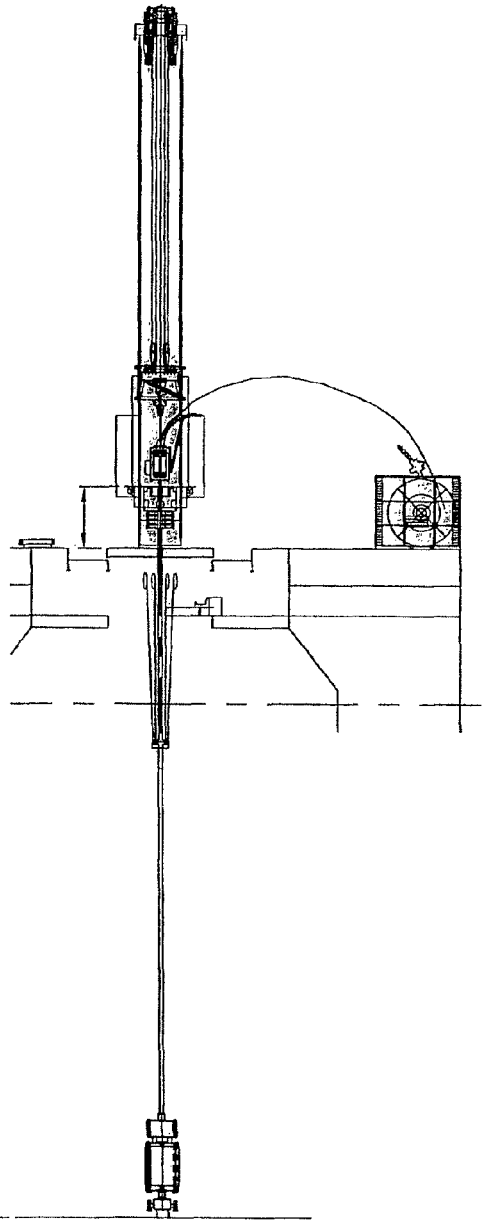

Now, the rigid interconnected assembly of subsea well control device 2, riser string, riser tensioning part 81, elongated riser part 83 and coiled tubing injector head 3 are all suspended from the hoisting device 30, allowing the disconnection of the moonpool skid cart 50 as visible in FIGS. 15*a* and 15*b*. Heave compensation during the installation of the rigid interconnected assembly on the sea is provided by the riser tensioner formed by the riser tensioning ring 60, cables and sheaves 65 and cables 66, and by the heave compensation system associated with the hoisting device. In FIGS. 15*a* and 15*b*, two extreme heave compensated positions of the vessel with respect to the bottom of the sea are visible.

The invention claimed is:

1. An offshore vessel capable of installing and removing a subsea well control device and a riser string, the vessel comprising:

a hull having a moonpool;

a mast having a top side and a base connected to the hull of the vessel, which mast is provided above or adjacent the moonpool;

a hoisting device supported by the mast for raising and lowering a load, comprising a travelling block for connecting the load to the hoisting device, which travelling block is displaceable along a firing line which extends through the moonpool;

a heave compensation system associated with the hoisting device, for damping the effect of the movement of the vessel as a result of sea-state induced vessel motion on the load attached to the travelling block; and a working deck which covers at least a portion of the moonpool to allow the assembly of a riser string, and wherein the firing line extends through an opening in said working deck, such that the hoisting device can raise and lower a load through the opening in the working deck, wherein said working deck is provided with a riser string suspension device, wherein a heave compensation connection system is provided, which is adapted to connect the working deck to the travelling block, such that the hoisting device can move the working deck when the working deck is connected to the travelling block between a lowered riser assembly position allowing the assembly of a riser string, and in which the working deck is supported by the hull, and a raised heave compensated position, in which the working deck is connected to the travelling block, and wherein the working deck is heave compensated.

2. The offshore vessel according to claim 1, further comprising well entry equipment, wherein the working deck is capable of supporting at least part of the well entry equipment and wherein the heave compensation connection system allows the working deck on which the part of the well entry equipment is positioned to be connected to the travelling block, in order to raise the working deck with the part of the well entry equipment to the raised heave compensated position to perform well entry operations.

3. The offshore vessel according to claim 2, wherein the part of the well entry equipment to be supported by the heave compensated working deck is an injector head.

4. The offshore vessel according to claim 3, wherein the heave compensation system comprises a passive heave compensation mechanism and an active heave compensation mechanism, and wherein in the raised heave compensated position the working deck can be active heave compensated or passive heave compensated, as desired.

5. The offshore vessel according to claim 3, wherein the mast has a closed box-like design with the firing line located outside, and wherein the heave compensation system is accommodated in the mast itself.

6. The offshore vessel according to claim 2, wherein the heave compensation system comprises a passive heave compensation mechanism and an active heave compensation mechanism, and wherein in the raised heave compensated position the working deck can be active heave compensated or passive heave compensated, as desired.

7. The offshore vessel according to claim 2, wherein the mast has a closed box-like design with the firing line located outside, and wherein the heave compensation system is accommodated in the mast itself.

8. The offshore vessel according to claim 1, wherein the heave compensation system comprises a passive heave compensation mechanism and an active heave compensation mechanism, and wherein in the raised heave compensated position the working deck can be active heave compensated or passive heave compensated, as desired.

9. The offshore vessel according to claim 1, wherein the mast has a closed box-like design with the firing line located outside, and wherein the heave compensation system is accommodated in the mast itself.

10. The offshore vessel according to claim 1, wherein the heave compensation system comprises one or more cylinders.

11. The offshore vessel according to claim 1, wherein the heave compensation system comprises an electronic system for detecting heave and for activating the hoisting device to provide active heave compensation.

12. The offshore vessel according to claim 1, wherein the heave compensation connection system is adjustable in length to adjust the distance between the travelling block and the working deck connected thereto.

13. The offshore vessel according to claim 1, wherein the riser string suspension device includes a clamping device or similar to suspend a string of risers from the working deck.

14. The offshore vessel according to claim 1, wherein said well entry operations include well interventions using coiled tubing or wireline.

15. The offshore vessel according to claim 1, wherein further a riser tensioner is provided to provide heave compensation to the riser string.

16. A method of operation of the offshore vessel according to claim 1, wherein the hoisting device raises the working deck to a raised heave compensated position, in which position the working deck is heave compensated.

17. The method according to claim 16, further comprising the steps of:

bringing the subsea well control device underneath the working deck into the firing line;

lowering both the subsea well control device and the working deck with the hoisting device;

assembling and connecting riser parts to the subsea well control device and to each other to form a riser string extending between the subsea well control device and the vessel, wherein the travelling block is used to lower the riser string and suspended subsea well control device; and installing the subsea well control device on the bottom of the sea.

18. The method according to claim 17, wherein the working deck is active heave compensated when lowering the subsea well control device and riser onto the bottom of the sea, and wherein the working deck is passive heave compensated when the subsea well control device is installed on the bottom of the sea.

19. The method according to claim 16, further comprising the steps of:

installing a riser tension ring onto the riser string;

installing part of the well entry equipment on the working deck, below the travelling block; and raising the working deck with the part of the well entry equipment to the raised heave compensated position.

20. The offshore vessel according to claim 1, wherein the heave compensation system comprises a passive heave compensation mechanism and an active heave compensation mechanism, and wherein in the raised heave compensated position the working deck can be active heave compensated or passive heave compensated, as desired, and wherein the working deck is active heave compensated when lowering the subsea well control device and riser onto the bottom of the sea, and wherein the working deck is passive heave compensated when the subsea well control device is installed on the bottom of the sea.

* * * * *